US007546822B2

(12) United States Patent
Murphy et al.

(10) Patent No.: US 7,546,822 B2
(45) Date of Patent: Jun. 16, 2009

(54) SWITCHING FINGER FOLLOWER ASSEMBLY

(75) Inventors: Richard F. Murphy, Torrington, CT (US); Matthew J. Deierlein, Middlebury, CT (US)

(73) Assignee: Timken US Corporation, Torrington, CT (US)

( * ) Notice: Subject to any disclaimer, the term of this patent is extended or adjusted under 35 U.S.C. 154(b) by 477 days.

(21) Appl. No.: 10/589,031

(22) PCT Filed: Mar. 2, 2005

(86) PCT No.: PCT/US2005/006709

§ 371 (c)(1),
(2), (4) Date: Aug. 9, 2006

(87) PCT Pub. No.: WO2005/093224

PCT Pub. Date: Oct. 6, 2005

(65) Prior Publication Data

US 2008/0149059 A1 Jun. 26, 2008

Related U.S. Application Data

(60) Provisional application No. 60/549,783, filed on Mar. 3, 2004, provisional application No. 60/635,503, filed on Dec. 13, 2004.

(51) Int. Cl.
*F01L 1/34* (2006.01)

(52) U.S. Cl. ..... 123/90.16; 123/90.39

(58) Field of Classification Search ..... 123/90.16, 123/90.39

See application file for complete search history.

(56) References Cited

U.S. PATENT DOCUMENTS

| | | | | |
|---|---|---|---|---|
| 3,742,921 | A * | 7/1973 | Rendine | 123/90.16 |
| 4,151,817 | A | 5/1979 | Mueller | |
| 4,607,600 | A | 8/1986 | Yoshizaki | |
| 4,768,467 | A | 9/1988 | Yamada et al. | |
| 5,287,830 | A | 2/1994 | Dopson et al. | |
| 5,529,033 | A | 6/1996 | Hampton | |

(Continued)

FOREIGN PATENT DOCUMENTS

| | | |
|---|---|---|
| EP | 1149988 | 10/2001 |

(Continued)

OTHER PUBLICATIONS

International Search Report and Written Opinion issued on Aug. 2, 2005 for corresponding International Application No. PCT/US2005/006709.

*Primary Examiner*—Zelalem Eshete
(74) *Attorney, Agent, or Firm*—Michael Best & Friedrich LLP

(57) ABSTRACT

A two-step finger follower rocker arm assembly comprising a follower body having a first end for engaging the engine and a second end for engaging a valve stem of the gas valve. The follower body has a passage formed in the body between the first and second ends and has a first bore traversing the passage. A central follower is positioned in the passage and is configured for engagement with the central lobe. A first lateral follower is pivotally supported on a shaft extending through the first bore and is configured to engage the at least one lateral cam lobe. A latching mechanism is positioned on the follower body for selectively latching the lateral follower to the body.

20 Claims, 8 Drawing Sheets

U.S. PATENT DOCUMENTS

| | | | |
|---|---|---|---|
| 5,655,488 | A | 8/1997 | Hampton et al. |
| 5,875,748 | A | 3/1999 | Haas et al. |
| 6,314,928 | B1 | 11/2001 | Baraszu et al. |
| 6,439,179 | B2 | 8/2002 | Hendriksma et al. |
| 6,467,445 | B1 | 10/2002 | Harris |
| 6,532,920 | B1 | 3/2003 | Sweetnam et al. |
| 6,591,798 | B2 | 7/2003 | Hendriksma et al. |
| 6,615,782 | B1 | 9/2003 | Hendriksma et al. |
| 6,668,775 | B2 | 12/2003 | Harris |
| 6,668,779 | B2 | 12/2003 | Hendriksma et al. |
| 6,691,657 | B2 | 2/2004 | Hendriksma et al. |
| 6,708,660 | B2 | 3/2004 | Seitz |
| 6,755,167 | B2 | 6/2004 | Krieg et al. |
| 6,810,844 | B2 | 11/2004 | Sellnau |
| 6,925,978 | B1 | 8/2005 | Gerzseny et al. |
| 2003/0209217 | A1 | 11/2003 | Hendriksma et al. |
| 2003/0217715 | A1 | 11/2003 | Pierik |
| 2004/0003789 | A1 | 1/2004 | Kreuter |
| 2004/0103869 | A1 | 6/2004 | Harris |

FOREIGN PATENT DOCUMENTS

| | | |
|---|---|---|
| EP | 1338760 | 8/2003 |
| JP | 60 159318 | 8/1985 |
| WO | 03042510 | 5/2003 |
| WO | WO 2005/075797 | 8/2005 |

* cited by examiner

SWITCHING FINGER FOLLOWER ASSEMBLY

RELATED APPLICATIONS

This application is a 371 of PCT/US 2005/006709 filed Mar. 2, 2005, which claims the benefit of U.S. Provisional Patent Application 60/549,783 filed Mar. 3, 2004, and U.S. Provisional Patent Application 60/635,503 filed Dec. 13, 2004.

BACKGROUND

The present invention relates to mechanisms for altering the actuation of valves in internal combustion engines; more particularly, to finger follower type rocker arms having means for changing between high and low valve lifts; and most particularly, to a two-step finger follower type rocker arm assembly, having a fixed central cam follower and a pair of pivotal lateral cam followers disposed on the finger follower body, and having locking means for latching and unlatching the lateral cam followers from the finger follower body to shift between high lift and low lift modes.

Variable valve activation (VVA) mechanisms for internal combustion engines are well known. It is known to be desirable to lower the lift of one or more valves of a multiple-cylinder engine, especially intake valves, during periods of light engine load. Such deactivation can substantially improve fuel efficiency.

Various approaches have been disclosed for changing the lift of valves in a running engine. One known approach is to provide an intermediary cam follower arrangement which is rotatable about the engine camshaft and is capable of changing both the valve lift and timing, the cam shaft typically having both high-lift and low-lift lobes for each such valve. Such an arrangement can be complicated and costly to manufacture and difficult to install onto a camshaft during engine assembly.

Another known approach is to provide a deactivation mechanism in the hydraulic lash adjuster (HLA) upon which a cam follower rocker arm pivots. Such an arrangement is advantageous in that it can provide variable lift from a single cam lobe by making the HLA either competent or incompetent to transfer the motion of the cam eccentric to the valve stem. A shortcoming of providing deactivation at the HLA end of a rocker arm is that, because the cam lobe actuates the rocker near its longitudinal center point, the variation in lift produced at the valve-actuating end can be only about one-half of the extent of travel of the HLA deactivation mechanism.

Still another known approach is to provide a deactivation mechanism in the valve-actuating end of a rocker arm cam follower (opposite from the HLA pivot end) which locks and unlocks the valve actuator portion from the follower body. Unlike the HLA deactivation approach, this approach typically requires both high-lift and low-lift cam lobes to provide variable lift.

Another known approach is to provide a rocker arm cam follower with a finger body having a first cam follower positioned within the finger body and a secondary cam follower. In some designs, the first cam follower is selectively moveable relative to the finger body and in other designs, the secondary cam followers are selectively moveable relative to the finger body. The moveable members generally are axially moveable or pivot about a secondary axis which adds complexity to the design or fails to provide smooth motion.

SUMMARY

The present invention provides a two-step finger follower rocker arm assembly for variably activating a gas valve of in an internal combustion engine having a camshaft having a central lobe and at least one lateral lobe adjacent a first side of the central lobe. The finger follower rocker arm assembly comprises a follower body having a first end for engaging the engine and a second end for engaging a valve stem of the gas valve. The follower body has a passage formed in the body between the first and second ends and has a first bore traversing the passage. A central follower is positioned in the passage and is configured for engagement with the central lobe. A first lateral follower is pivotally supported on a shaft extending through the first bore and is configured to engage the at least one lateral cam lobe. A latching mechanism is positioned on the follower body for latching the lateral follower to the body to cause the motion of the at least one lateral cam lobe to be translated to the body in a first rocker assembly mode having a first valve lift capability and for unlatching the lateral follower from the body to cause engagement of the central follower with the central camshaft lobe to provide a second rocker assembly mode having a second valve lift capability.

DETAILED DESCRIPTION OF THE PREFERRED EMBODIMENTS

The present invention will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting.

Figure 1:
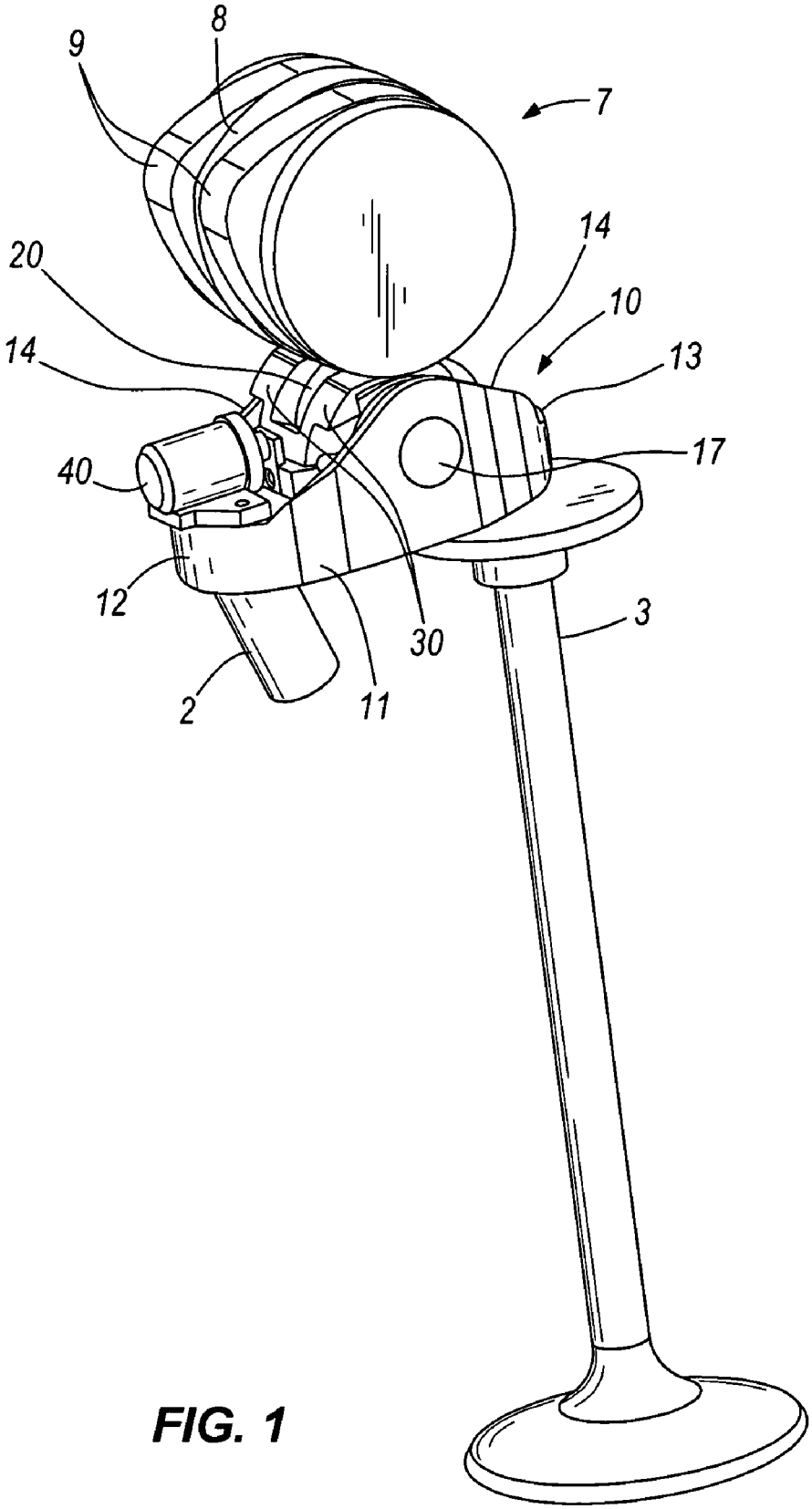
FIG. 1 is an isometric view of a finger follower assembly that is a first embodiment of the present invention as it is mounted in an engine.
Figure 2:
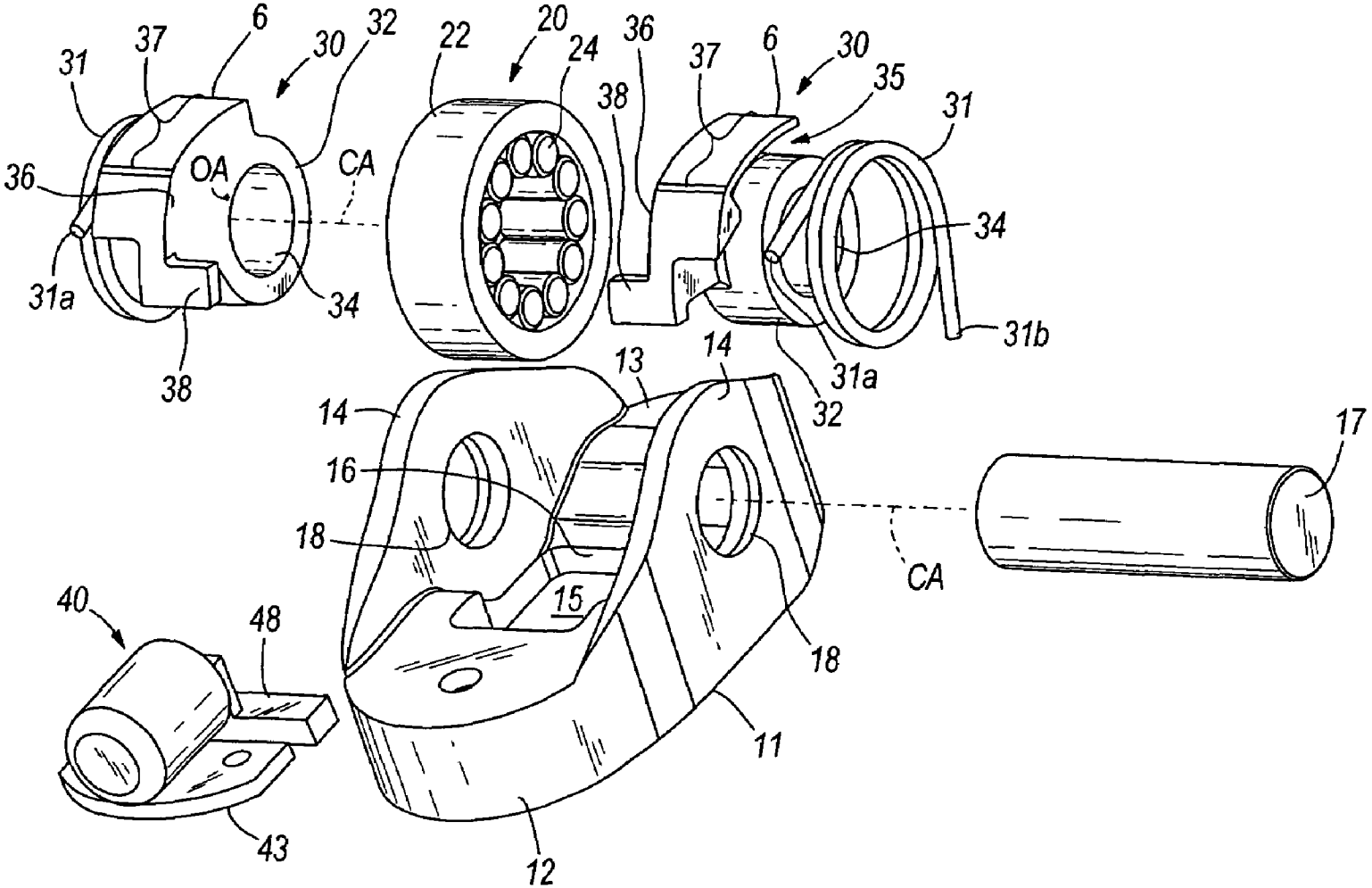
FIG. 2 is an exploded view of the finger assembly of FIG. 1.

Referring to FIGS. 1-4, a finger follower rocker arm assembly 10 that is a first embodiment of the present invention will be described. As shown in FIGS. 1 and 2, the rocker arm assembly 10 includes a finger body 11 with one end 12 having a spherical socket 19 configured to engage the engine such as through a typical lash adjuster 2 and a second end 13 configured to engage a typical valve stem 3. Opposed side walls 14 extend between the ends 12, 13 and define an opening 15 in the central area of the finger body 11.

A central cam follower 20 is mounted in the opening 15 with a lateral follower 30 on each side thereof. Each lateral follower 30 is positioned between the central cam follower 20 and a respective side wall 14 of the finger body 11. The central cam follower 20 and the lateral followers 30 are supported on a single shaft 17 extending through a bore 18 extending through the side walls 14 transverse to the opening 15. The preferred central cam follower 20 includes a cylindrical race 22 with a roller complement 24 positioned therein such that the cylindrical race 22 is rotatable about the shaft 17. The central cam follower 20 is positioned to contact the low or zero lift cam lobe 8 of a camshaft 7, as illustrated in FIG. 1.

Figure 3:
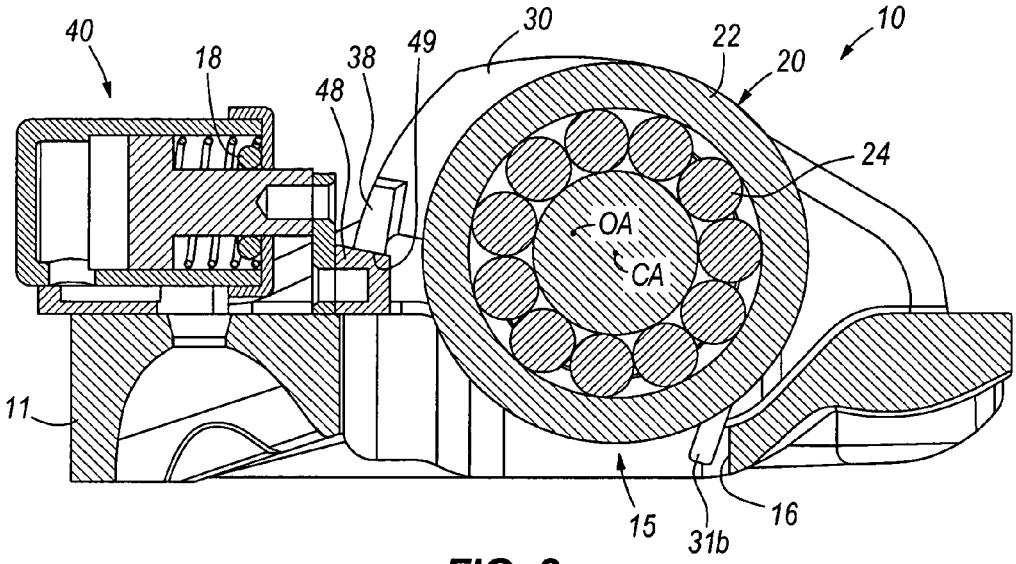
FIG. 3 is a cross section view of the finger assembly of FIG. 1 with the locking mechanism engaged.
Figure 4:
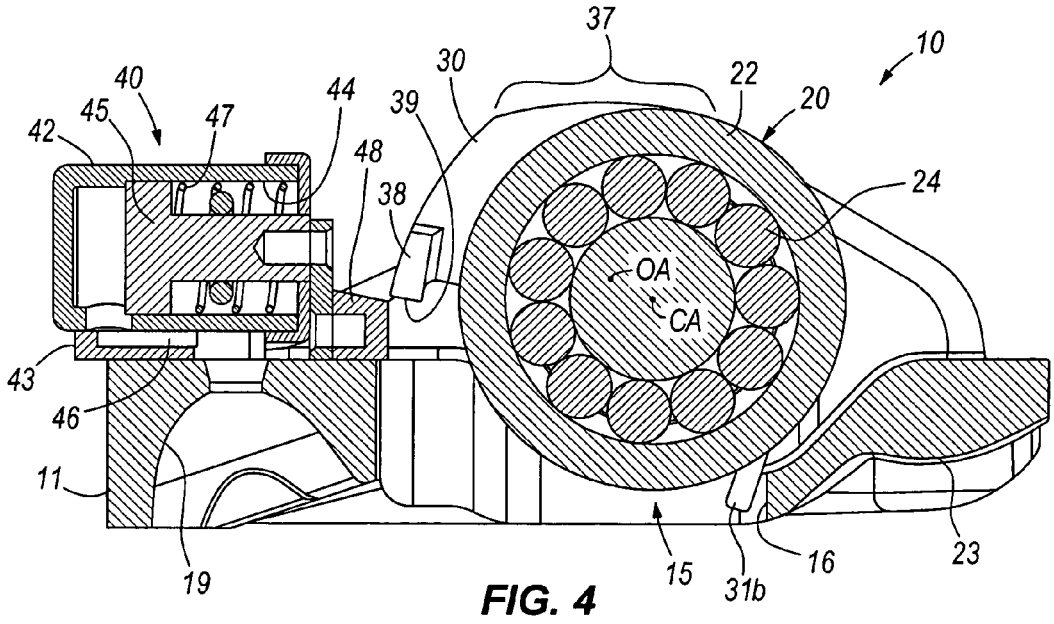
FIG. 4 is a similar view to FIG. 3 with the locking mechanism disengaged.

Referring to FIGS. 2-4, each lateral follower 30 has a body portion 32 with a through bore 34 configured to receive and pivot about the shaft 17. Each through bore 34 is co-axial with the shaft 17 and the central cam follower 20 along axis CA. Each lateral follower 30 further includes a contact portion 36 extending from the body portion 32. The contact portion 36 includes a convex contact surface 37 configured to contact a respective high lift lobe 9 as illustrated in FIG. 1. The contact surface 37 has an axis of rotation OA that is offset from the central axis CA. As such, contact of the respective high lift lobe 9 with the contact surface 37 will cause a pivoting force on the lateral follower 30. As will be described hereinafter, each lateral follower 30 is lockable relative to the finger body 11 such that the pivoting force of the high lift lobe 9 will be transmitted to the finger body 11. In the unlocked condition, the lateral follower 30 simply pivots about the central axis CA without imparting any significant force on the finger body 11. Each lateral follower 30 is biased toward an upper position by a torsion spring 31 or the like. In the preferred embodiment, a torsion spring 31 is positioned about each body portion 32. As shown in FIG. 2, the contact portion 36 defines an open space 35 relative to the body portion 32 to receive and retain a first end 31*a* of the torsion spring 31. As shown in FIG. 3, the opposite end 31*b* of the torsion spring 31 is received in the opening 15 and abuts a transverse surface 16 thereof.

A locking tab 38 is provided on each lateral follower 30. Each locking tab 38 is configured to be selectively engaged by a locking mechanism 40 to prevent pivoting of the lateral followers 30 about the shaft 17. The locking tab 38 protrudes from the lateral follower body portion 32. When positioned in the finger body the end faces of each locking tab 38 contact each other forming an opening of the proper size for the cam roller 20. This prevents the lateral followers 30 from "pinching" the cam roller during operation. In the locked condition, see FIG. 3, the valve lift is controlled by the high lift lobes 9 as the pivoting force is transmitted through the lateral followers 30, through the locking mechanism 40 and to the finger body 11. When the locking mechanism 40 is disengaged, see FIG. 4, the valve lift is controlled by the low lift lobe 8 through the central cam follower 20, with the lateral followers 30 pivoting about the shaft 17 against the force of the torsion springs 31. The locking tabs 38 are sized to form a properly sized slot for the central cam follower 20.

Figure 5:
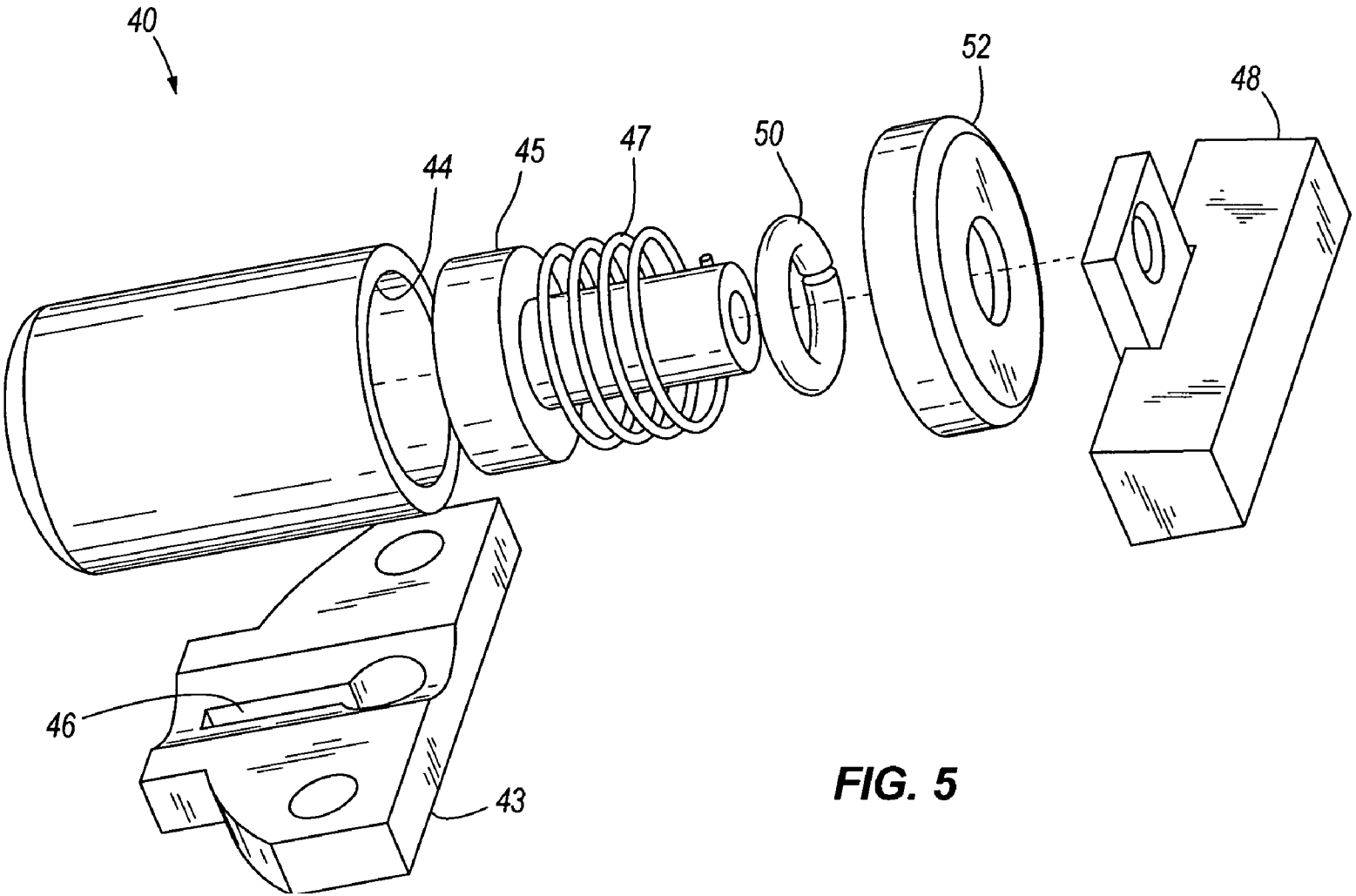
FIG. 5 is an exploded view of the locking mechanism of the first embodiment of the present invention.

A preferred locking mechanism 40 will be described with reference to FIGS. 4 and 5. The preferred locking mechanism 40 includes a hydraulic actuator 42 attached to the top of the finger body 11 over the lash adjuster directly or by a base plate 43. The hydraulic actuator 42 has an outer body with a cylindrical bore 44 and a piston 45 inside the bore. Pressurized oil is supplied from the lash adjuster to the bore 44 through a channel 46 in the base plate 43. A spring 47 is positioned in the bore 44 and acts on the piston 45 biasing it to the oil supply end of the bore 44. Sufficient oil pressure causes the piston 45 to move away from the oil supply end. A locking bar 48 is provided on the free end of the piston 45 and is moveable by oil pressure toward the locking tabs 38 of the lateral followers 30. The locking bar 48 can move under the contact tabs 38 and contact their locking surfaces 39 to engage the locking mechanism 40. The locking bar 48 bridges a slot in the center portion of the finger. When the oil pressure is decreased to a pre-determined level, the spring 47 moves the piston 45 and locking bar 48 from under the locking tabs 38, allowing the lateral followers 30 to pivot in the opening 15, thus disengaging the locking mechanism 40. Alternatively, the locking bar may be omitted and the piston 45 configured to directly contact the locking tabs 38 of the lateral followers 30.

In order to accurately control the motion of the engine valve, the position of the lateral follower contact surfaces 37 needs to be precisely positioned relative to the finger body valve stem contact surface 23 and the lash adjuster contact surface 22. Variation in this position may cause the locking mechanism 40 to not engage or not allow the valve to completely open in the high lift mode. This variation can be caused by normal deviations during the manufacture of the finger body 11 and lateral followers 30. The surface 49 of the locking bar 48 that contacts the lateral followers 30 preferably has a slightly tapered shape with the locking tabs 38 locking surfaces 39 having a matching taper. The further the locking bar 48 moves under the locking tabs 38, the higher the lateral follower contact surface 37 is relative to the finger body 11. Located on the actuator piston 45 is an adjusting ring 50 that limits the travel of the piston 45 by contacting the actuator end cap 52 which is attached to the actuator body. This ring 50 is moveable on the piston 45 only by a force which is significantly higher than the force exerted by the piston 45 under high pressure oil conditions. During the manufacture of the finger follower assembly 10, when the actuator 42 is first assembled onto the finger body 11, the adjusting ring 50 is positioned significantly towards the locking bar 48 end of the piston 45. The assembled finger assembly 10 can then be put in a fixture that locates the lateral followers 30 to accurately represent the position of the contact surface 37 as when assembled into an engine. The locking bar 48 is then positioned under the locking tabs 38 the proper distance such that the tapered surfaces 49, 39 of the locking bar 48 and locking tabs 38, respectively, cause the lateral follower contact surfaces to rise to the proper cam contact height. While the locking bar 48 and piston 45 are being moved, the adjusting ring 50 is forced to slide down the piston 45 by contact with the end cap 52. The adjusting ring 50 will thereby be set to a desired stop position such that during normal operation in the engine, the adjusting ring 50 provides a stop for the piston travel, thus ensuring the lateral follower contact surfaces 37 are at the proper height.

Referring to FIGS. 6-11, a switching finger follower rocker arm assembly 110 in accordance with a second embodiment of the invention is shown. The rocker arm assembly 110 includes a follower body 112 having a first end 114 having means for receiving the head of a hydraulic lash adjuster 2 for pivotally mounting assembly 110 in an engine (not shown). The receiving means is preferably a spherical socket 120, as shown in FIGS. 8-11. An opposite end 122 of follower body 112 is provided with a pad 124, preferably arcuate, for interfacing with and actuating a valve stem 5 of gas valve 3. The rocker arm assembly 110 is aligned with a camshaft 7 having multiple cam lobes 9, 8 and 9, as will be described hereinafter.

The follower body 112 is provided with a passage 128 therethrough between socket 120 and pad 124, passage 128 being generally configured to receive a cam follower 132. Body 112 is further provided with a first bore 134 transverse of passage 128 for supporting a shaft 140 extending through bore 134 and a central bore 133 in the cam follower 132 to support the cam follower 132 in passage 128 for rotation about the shaft 140 axis X. The central bore 133 is preferably provided with a roller bearing assembly (not shown) to facilitate rotation about the shaft 140, but may otherwise be configured for rotation.

First and second lateral slider followers 142*a,b* are mounted on opposite ends, respectively, of shaft 140 such that the slider followers 142*a,b* are supported for rotational motion about the shaft 140 axis X. Each slider follower 142*a,b* has an arcuate outer surface 144 for engaging an outer cam lobe 9 of the engine camshaft 7, as will be described hereinafter. The arcuate outer surfaces 144 are such that the center of the curve is located offset from the shaft 140 axis X such that a rotating force is created on the slider followers 142*a,b* when a force is applied by the cam lobes 9.

Figure 9:
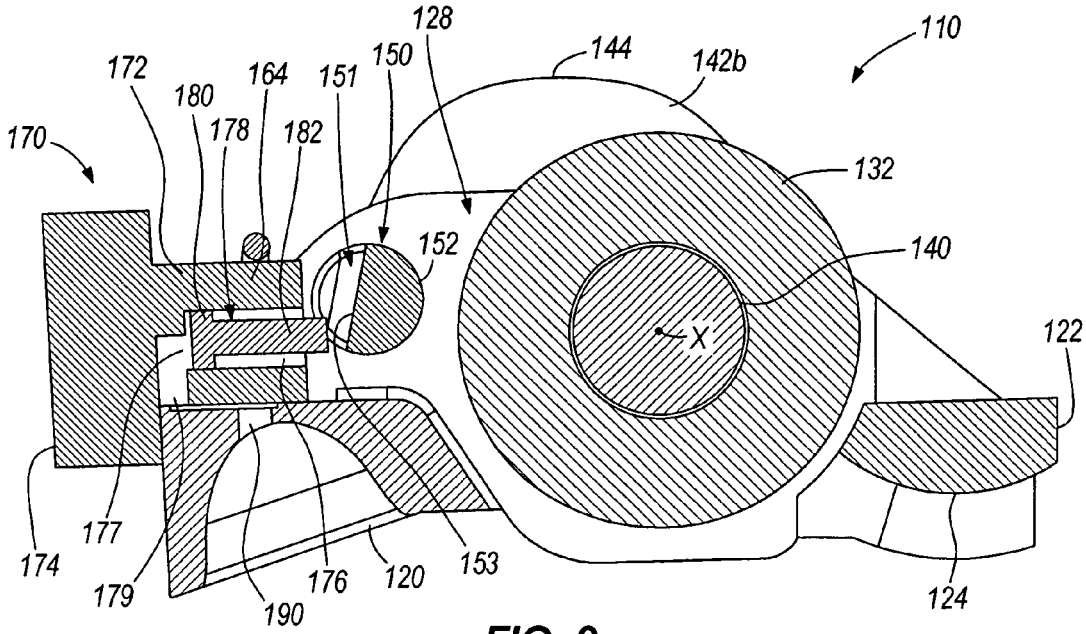
FIG. 9 is a cross sectional view of the finger follower assembly as it is shown in FIG. 8.
Figure 11:
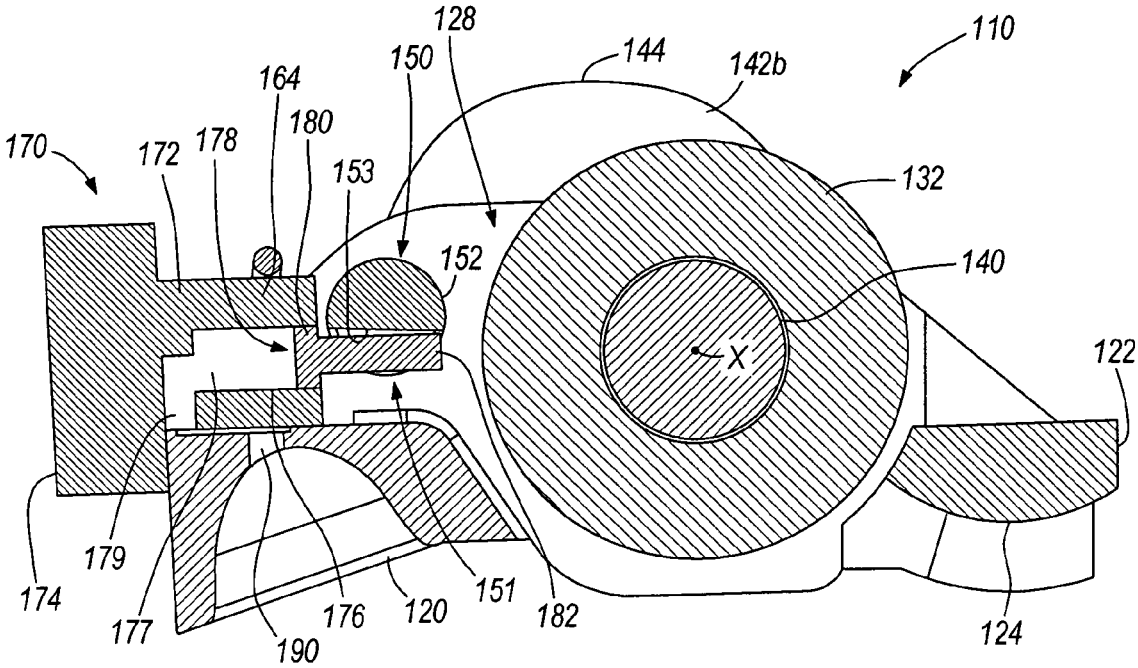
FIG. 11 is a cross sectional view of the finger follower assembly as it is shown in FIG. 10.

On an opposite lower surface 143, each slider follower 142*a,b* is provided with a retaining notch 145 configured to receive an end of a spring member 160. Referring to FIGS. 6, 7, 9 and 11, the spring member 160 is configured such that a first end 162 positioned in the retaining notch 145 of one of the slider followers 142*a*. The spring member 160 extends from the end 162 and coils about and is retained in a circumferential groove 141 of the shaft 140. The spring member 160 has a bridging portion 164 that extends across the first end 114 of the follower body 112. The spring member 160 coils about and is retained in a circumferential groove 141 on the opposite end of the shaft 140. With the spring member 160 retained in both grooves 141, the spring member 160 secures the slider followers 142*a,b* on the shaft 140 and unitizes the assembly. The spring member 160 has a second end 166 that terminates and is retained in the retaining notch 145 on the other slider follower 142*b*. The spring member 160 thereby biases both slider followers 142*a,b* in an upward arc about the axis X to an upper, cam lobe engaging position. As shown in FIGS. 9 and 11, in the upper, cam lobe engaging position, the arcuate outer surface 144 of each slider follower 142*a,b* extends higher than the outer surface of the cam follower 132.

Each slider follower 142*a,b* is also provided with a locking notch 148 along an end of the slider 142 proximate the first end 114 of the follower body 112. Each locking notch 148 includes a flat engagement surface 149 configured for selective engagement by a flat engagement surface 155 of a locking pin 150 extending through the follower body 112. Referring to FIGS. 7-11, the locking pin 150 has a central body 152 that is positioned through and rotationally supported in second bores 135 extending through the body 112 transverse to the passage 128. The ends 154, 156 of the locking pin 150 extend outward of the follower body 112. Each end 154, 156 has a generally semicircular configuration to define a respective flat engagement surface 155.

Figure 8:
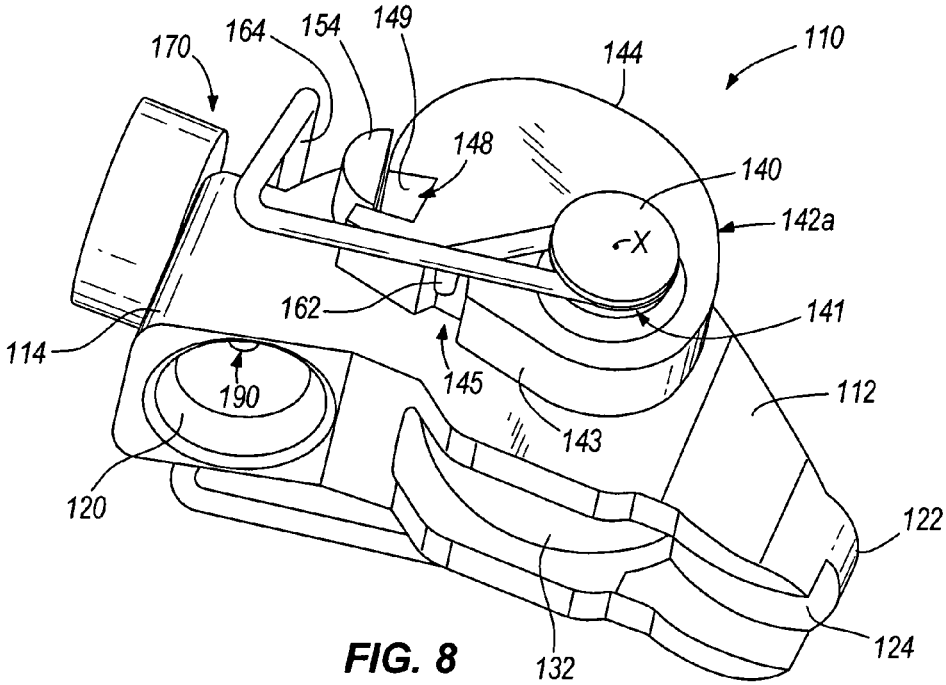
FIG. 8 is an isometric view of the finger follower assembly of FIG. 6 with the locking pin in an unlocked position.

As shown in FIG. 8, in a first, unlocked position, the locking pin ends 154, 156 are clear of the locking notch 148. The slider followers 142*a,b* are thereby free to rotate about axis X upon contact by the cam lobes 9. As such, in this unlocked condition, the slider followers 142*a,b* do not exert a rotational force on the follower body 112, but instead rotate freely and independently of the follower body 112.

Figure 10:
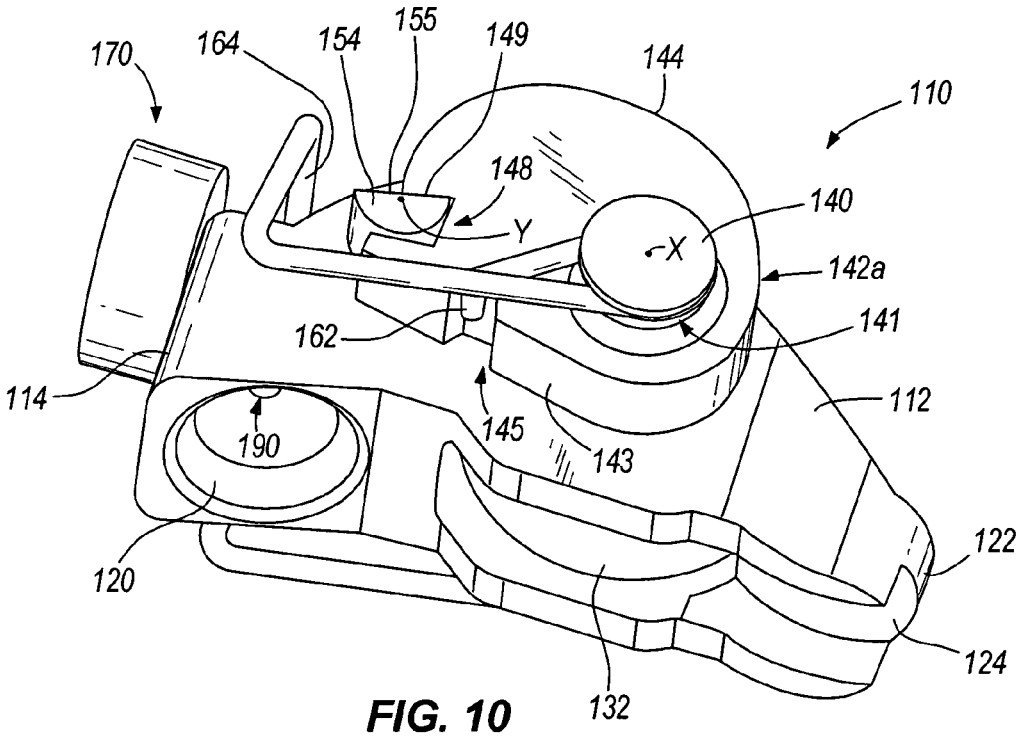
FIG. 10 is an isometric view of the finger follower assembly of FIG. 6 with the locking pin in a locked position.

Referring to FIG. 10, upon rotation of the locking pin 150, each locking pin end 154, 156 is rotated to a second, locked position wherein the end 154, 156 is received in a respective one of the locking notches 148. Each locking pin engagement surface 155 contacts a respective locking notch engagement surface 149, thereby preventing rotation of the slider followers 142*a,b* about the axis X. As such, the force of the cam lobes 9 will be directed through the locked slider followers 142*a,b* to the follower body 112, causing the follower body 112 to rotate and providing a high lift to the valve stem 5. In the preferred embodiment, the notch engagement surfaces 149 contact the locking pin engagement surfaces 155 beyond the axis Y of the locking pin 150 so that the contact force passes through the axis Y and does not provide as great of a rotational force on the locking pin 150 in an unlocking direction.

The locking pin 150 is preferably rotated between the unlocked position and the locked position by a hydraulic actuator 170, however, the locking pin 150 may be rotated by other mechanical or electromechanical means, for example, an electric solenoid actuator. The hydraulic actuator 170 will be described with reference to FIGS. 7, 9 and 11. The hydraulic actuator 170 has a body 172 configured to be positioned between the walls 113, 115 of the follower body 112 adjacent the first end 114. The body 172 preferably has a head 174 to limit axial movement of the body 172 relative to the follower body 112. The bridge portion 164 of the spring member 160 extends over the actuator body 172 to retain the actuator body 172 within the sidewalls 113, 115.

The actuator body 172 has an internal bore 176 configured to receive and support a piston member 178 having a piston head 80 and a piston shaft 182. The piston head 180 seals against the inside surface of the bore 176 such that the bore 176 and the piston head 180 define a fluid chamber 177. A fluid passage 179 extends from an external surface of the actuator body 172 to the fluid chamber 177. A fluid channel 190 extends from the lash socket 120 and is in sealed communication with the fluid passage 179 such that a sealed fluid path is formed between the lash socket 120 and the fluid chamber 177. As fluid pressure passing through the lash adjuster 2 increases, the pressure in the fluid chamber 177 increases and causes the piston member 178 to move toward the locking pin 150. The amount of fluid pressure passing through the lash adjuster 2 may be controlled in various manners, for example, through command from an engine control module (not shown).

Referring to FIGS. 9 and 11, the locking pin central body 152 has a cutout portion 151 that defines a generally flat surface 153 in alignment with the piston shaft 182. With the piston member 178 retracted, the piston shaft 182 is clear of the flat surface 153 and the locking pin 150 is free to rotate to the unlocked position as shown in FIGS. 8 and 9. As the piston member 178 is extended, the piston shaft 182 contacts the flat surface 153 and thereby rotates the locking pin 150 to the locked position as shown in FIGS. 10 and 11. A spring or the like (not shown) may be provided about the piston shaft 182 to bias the piston member 178 to the unlocked position.

Figure 6:
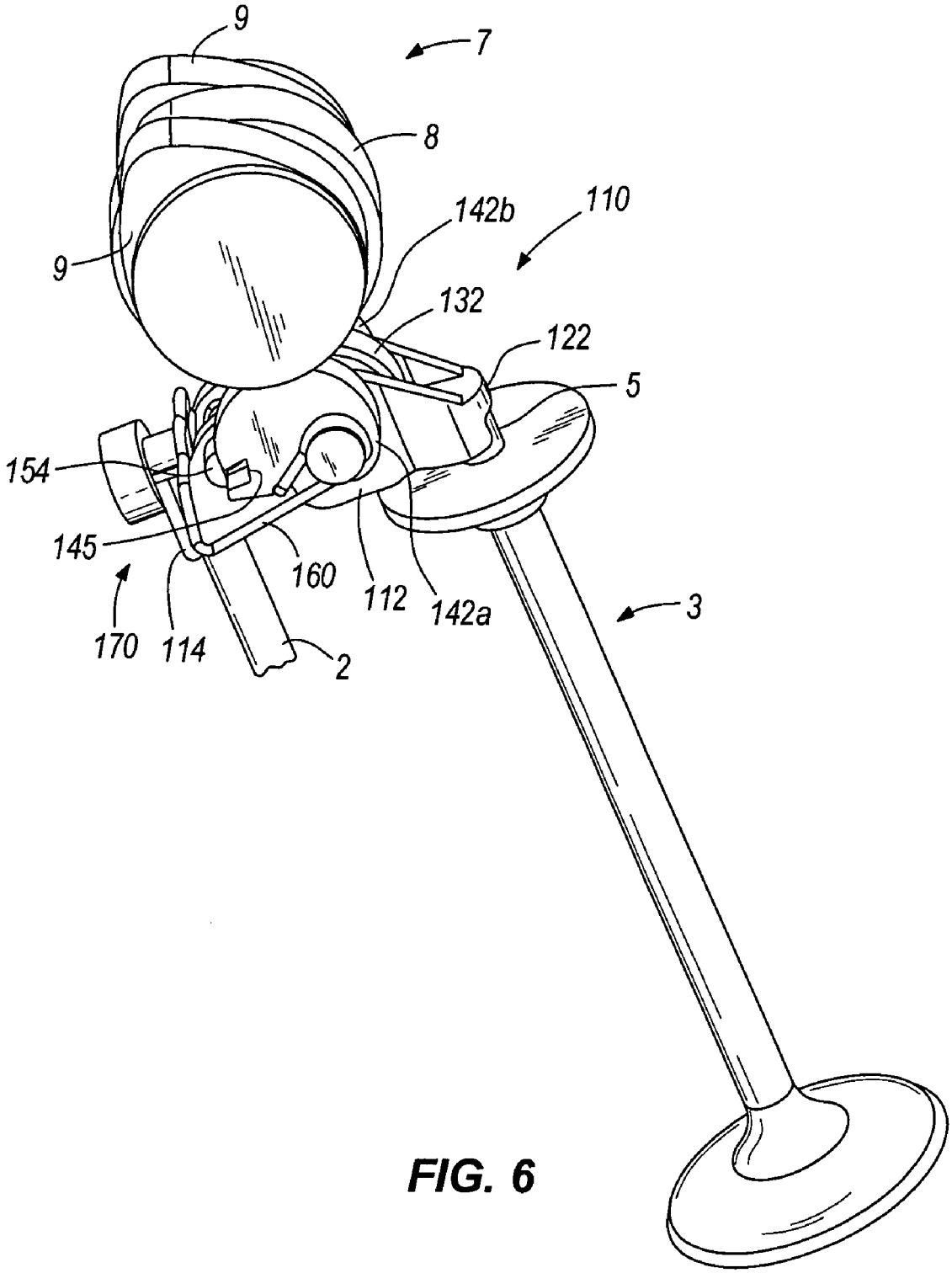
FIG. 6 is an isometric view of a finger follower assembly that is a second embodiment of the present invention installed schematically in an internal combustion engine.
Figure 7:
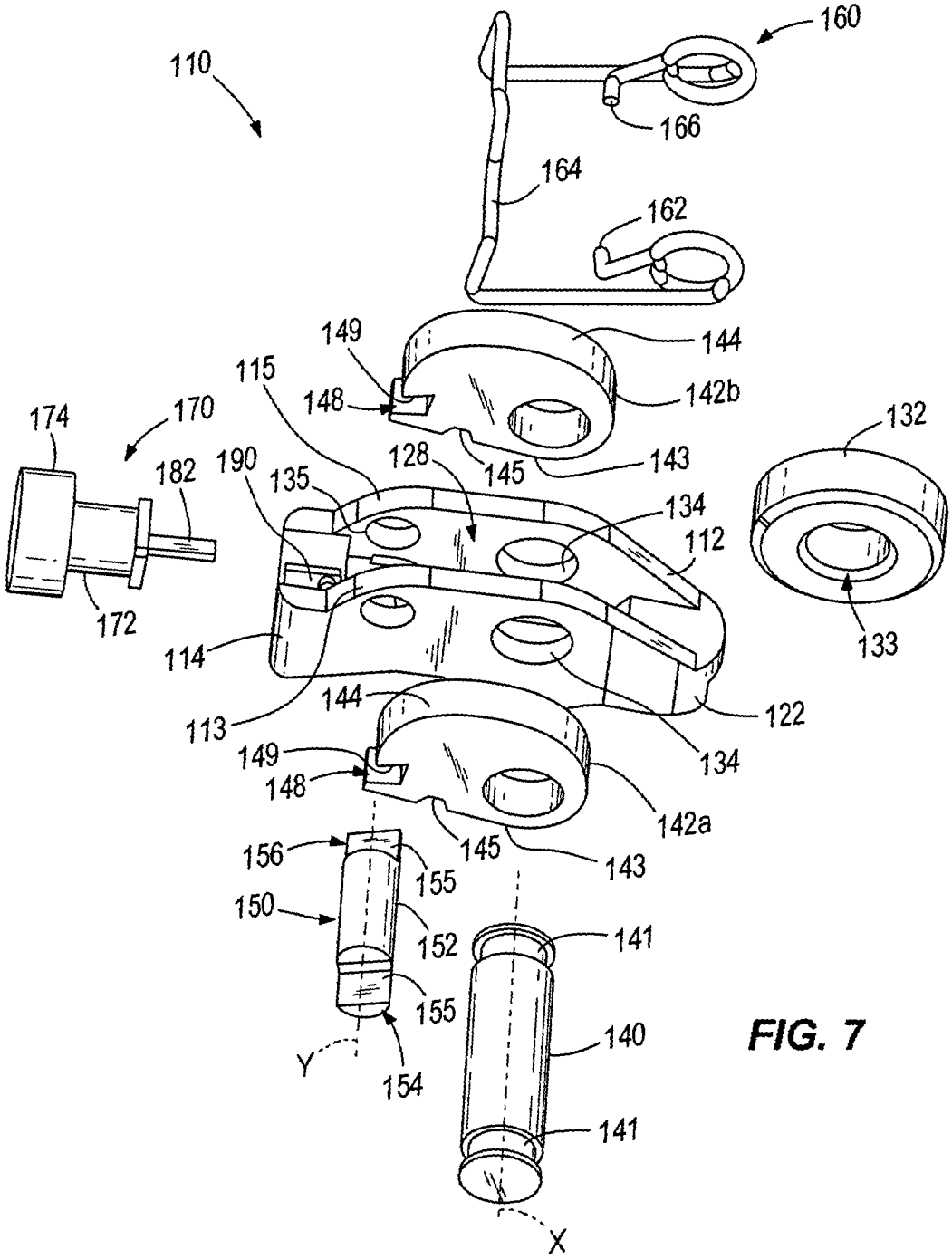
FIG. 7 is an exploded isometric view of the finger follower assembly of FIG. 6.

Having described the components of the finger follower assembly 110, its operation will now be described with reference to FIGS. 6-11. Referring to FIG. 6, the camshaft 7 includes a central cam lobe 8 that is aligned with the cam follower 132. The central cam lobe 8 is flanked by first and second lateral cam lobes 9 for selectively engaging the slide followers 142*a,b*, respectively.

When the engine is operating in a low oil pressure mode, such that a low-lift condition is desired, the oil pressure passing through the latch socket 120 will be low, thereby maintaining the piston member 178 in a retracted position. As shown in FIGS. 8 and 9, with the piston member 178 in the retracted position, the locking pin 150 is rotated to the unlocked position, with the locking pin ends 154, 156 clear of the slider follower locking notches 148. In this unlocked condition, as the camshaft 7 rotates and the lateral cam lobes 9 contact the respective slider followers 142*a,b*, the slider followers 142*a,b* simply rotate about the shaft 140 axis X and do not impart any force upon the follower body 112. At the same time, rotation of the camshaft 7 causes the central cam lobe 8 to contact the cam follower 132. Since the cam follower 132 is supported by the follower body 112 via shaft 140, the force of the central cam lobe 8 will be transmitted to the follower body 112, resulting in low-lift actuation of the valve stem 5.

When the engine is operating in a higher oil pressure mode, such that a high-lift condition is desired, the oil pressure passing through the latch socket 120 increases and causes the piston member 178 to move to the extended position. As shown in FIGS. 10 and 11, with the piston member 178 in the extended position, the piston shaft 182 contacts the locking pin flat surface 153 and rotates the locking pin 150 to the locked position, with the locking pin ends 154, 156 extending in to the slider follower locking notches 148. The locking pin engagement surfaces 155 contact the locking notch engagement surfaces 149, thereby locking the slider followers 142*a,b* against rotation. In this locked condition, as the camshaft 7 rotates and the lateral cam lobes 9 contact the respective slider followers 142*a,b*, the slider followers 142*a,b* can not rotate about the shaft 140 axis X, but instead the force of the lateral cam lobes 9 is transmitted through the slide followers 142*a,b* to the follower body 112, resulting in high-lift actuation of the valve stem 5. The central cam lobe 8 will also be rotating, but will be spaced from and therefore not contact the cam follower 132.

What is claimed is:

1. A finger follower rocker arm assembly for variably activating a gas valve of an internal combustion engine having a camshaft having a central lobe and at least one lateral lobe adjacent a first side of the central lobe, comprising:

a follower body having a first end for engaging the engine and a second end for engaging a valve stem of the gas valve and having a passage formed in the body between the first and second ends and having a first bore traversing the passage;

a central follower configured for engagement with the central lobe and rotatably supported in the passage by a shaft extending through the first bore and;

a first lateral follower configured to engage the at least one lateral cam lobe and pivotally supported on the shaft; and a latching mechanism disposed on the follower body for selectively latching the lateral follower to the body to cause the motion of the at least one lateral cam lobe to be translated to the body in a first rocker assembly mode having a first valve lift capability and for unlatching the lateral follower from the body to cause engagement of the central follower with the central camshaft lobe to provide a second rocker assembly mode having a second valve lift capability.

2. The finger follower rocker arm assembly of claim 1 wherein the central follower includes an outer race with a rolling element complement positioned therein between the outer race and the shaft.

3. The finger follower rocker arm assembly of claim 1 wherein the first lateral follower includes a through bore configured to receive and pivot about the shaft, the through bore having a through bore axis co-axial with a shaft axis.

4. The finger follower rocker arm assembly of claim 3 wherein the first lateral follower includes a convex contact surface having an axis of rotation and wherein the axis of rotation is offset from the through bore axis.

5. The finger follower rocker arm assembly of claim 4 wherein the first lateral follower is biased toward a position in which the convex contact surface is radially outward relative to a contact surface of the central follower.

6. The finger follower rocker arm assembly of claim 1 wherein the first lateral follower includes a locking tab configured to be engaged by the latching mechanism in the first rocker assembly mode.

7. The finger follower rocker arm assembly of claim 6 wherein the latching mechanism includes a piston axially moveable between a latched position and an unlatched position.

8. The finger follower rocker arm assembly of claim 7 wherein the latching mechanism further comprises an axially moveable locking bar and wherein in the latched position, the piston moves the locking bar into engagement with the lateral follower locking tab and in the unlatched position, the locking bar is free to move to a nonengaged position relative to the lateral follower locking tab.

9. The finger follower rocker arm assembly of claim 8 wherein the locking bar includes a tapered contact surface.

10. The finger follower rocker arm assembly of claim 7 wherein the piston is configured to directly engage the lateral follower locking tab in the latched position.

11. The finger follower rocker arm assembly of claim 7 wherein the latching mechanism further comprises a rotatable locking pin and wherein in the latched position, the piston rotates the locking pin into engagement with the lateral follower locking tab and in the unlatched position, the locking pin is free to rotate to a nonengaged position relative to the lateral follower locking tab.

12. The finger follower rocker arm assembly of claim 7 wherein a stop ring is positioned about the piston, the stop ring being axially adjustable to control the stroke of the piston.

13. The finger follower rocker arm assembly of claim 7 wherein the piston is biased toward the unlatched position.

14. The finger follower rocker arm assembly of claim 13 wherein the latching mechanism includes a fluid chamber configured to receive fluid to move the piston against the bias toward the latched position.

15. The finger follower rocker arm assembly of claim 14 wherein the follower body includes a spherical socket configured to contact a lash adjuster and wherein the spherical socket is in fluid communication with the fluid chamber.

16. The finger follower rocker arm assembly of claim 1 wherein the first lateral follower is positioned within the passage.

17. The finger follower rocker arm assembly of claim 16 further comprising a second lateral follower positioned within the passage on an opposite side of the central follower and pivotally supported on the shaft, the second lateral follower being configured to contact a second lateral cam lobe.

18. The finger follower rocker arm assembly of claim 17 wherein the first lateral follower includes a first locking tab extending toward the second lateral follower and the second lateral follower includes a second locking tab extending toward the first lateral follower, the first and second locking tabs defining an open area for the central follower.

19. The finger follower rocker arm assembly of claim 1 wherein the first lateral follower is positioned external to the passage.

20. The finger follower rocker arm assembly of claim 19 further comprising a second lateral follower positioned external to the passage on an opposite side of the central follower and pivotally supported on the shaft, the second lateral follower being configured to contact a second lateral cam lobe.

* * * * *